United States Patent [19]

Sussman

[11] Patent Number: 4,782,777

[45] Date of Patent: Nov. 8, 1988

[54] INFLATABLE CATAMARAN

[76] Inventor: Robert A. Sussman, P.O. Box 3744, Tustin, Calif. 92860

[21] Appl. No.: 936,378

[22] Filed: Dec. 1, 1986

[51] Int. Cl.[4] ..... B63B 35/00

[52] U.S. Cl. ..... 114/39.1; 114/345; 114/357; 114/61

[58] Field of Search ..... 114/343, 345, 357, 39.1, 114/61, 123, 292; 441/40, 41

[56] References Cited

U.S. PATENT DOCUMENTS

| | | | |
|---|---|---|---|
| 2,573,745 | 11/1951 | Wallenberg | 114/39.1 |
| 3,763,813 | 10/1973 | Holtz | 114/123 |
| 3,859,943 | 1/1975 | Katainen | 114/39 |
| 3,866,557 | 2/1975 | Lang | 114/61 |
| 3,885,512 | 5/1975 | Marcil | 114/61 |
| 3,902,443 | 9/1975 | McDougall | 114/123 |
| 4,046,091 | 9/1977 | Lomas et al. | 114/61 |
| 4,136,414 | 1/1979 | Popkin | 114/61 |
| 4,223,620 | 9/1980 | Dudouyt | 114/61 |

*Primary Examiner*—Joseph F. Peters, Jr.
*Assistant Examiner*—Stephen P. Avila
*Attorney, Agent, or Firm*—Harris, Kern, Wallen & Tinsley

[57] ABSTRACT

An inflatable catamaran which may be constructed principally of plastic sheet stock and plastic tubing and be easily assembled for use and disassembled for storage and shipping. A catamaran with inflatable pontoons having fore and aft pockets on each side thereof and spreader members with depending ends spaced laterally for inserting into the pontoon pockets joining the pontoons and spreader members in a rectangular catamaran configuration. A deck may be formed between the spreader members, and mast and keel are attached to one spreader member and a rudder to the other spreader member.

4 Claims, 2 Drawing Sheets

FIG. 1
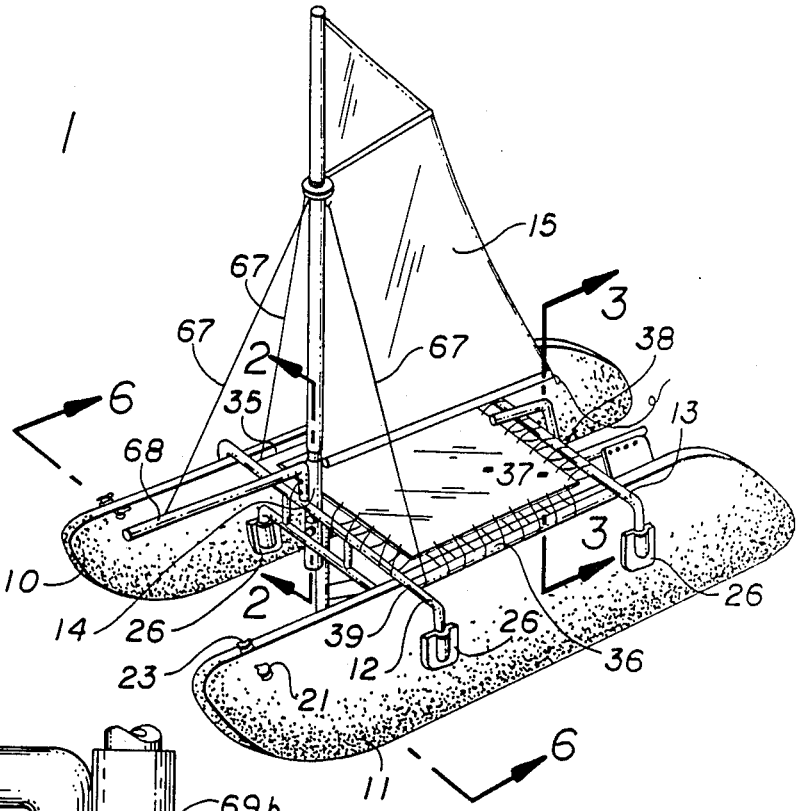
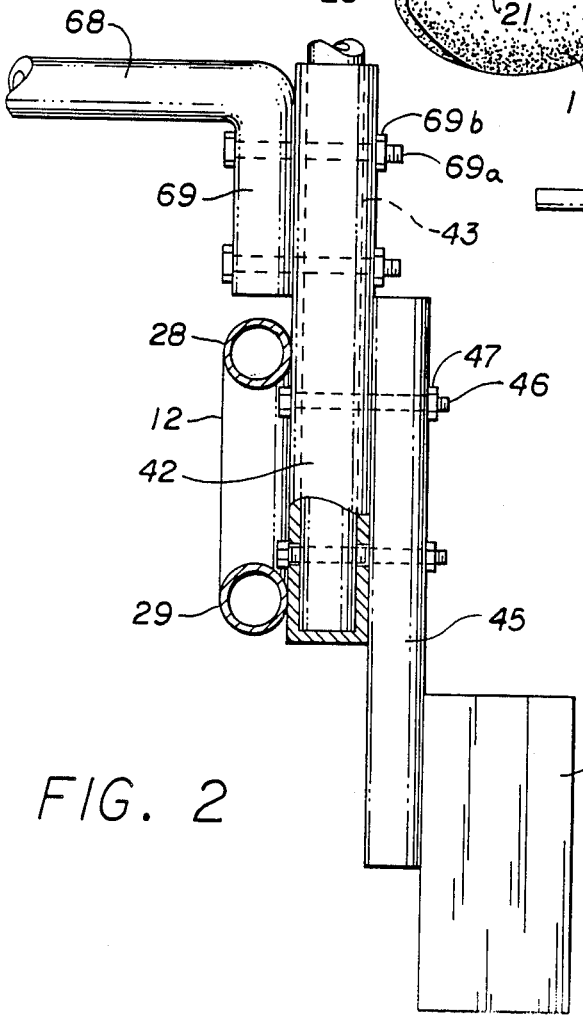
FIG. 2
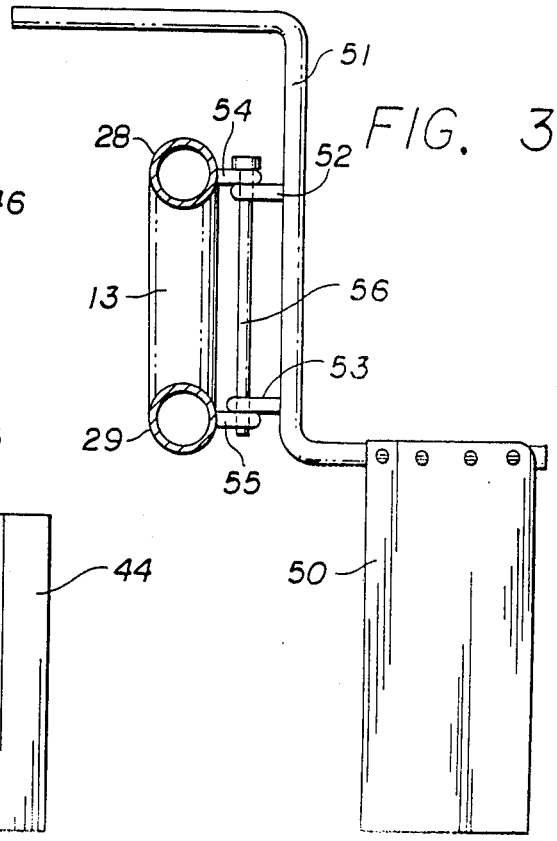
FIG. 3

FIG. 4
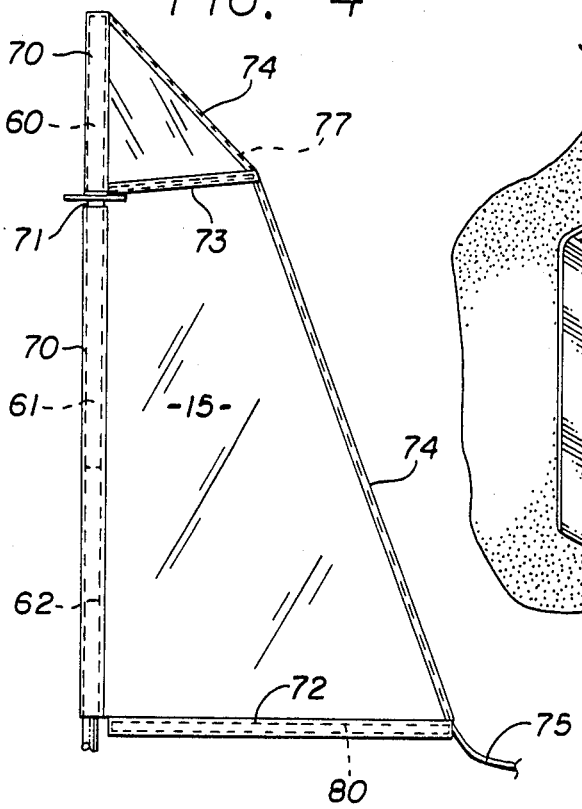
FIG. 5
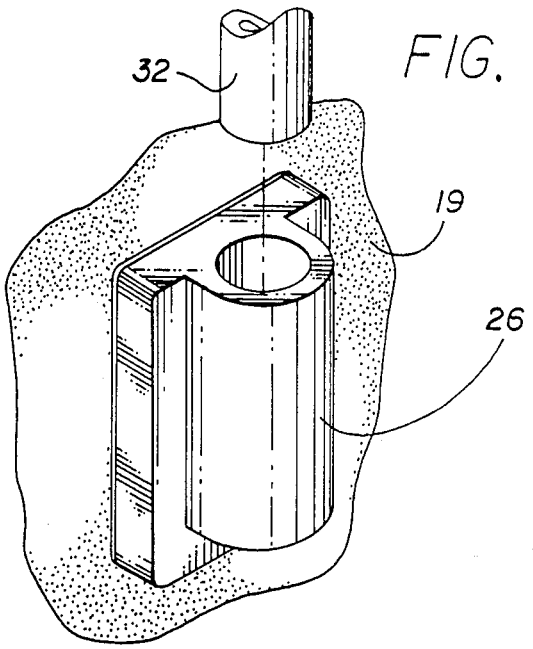
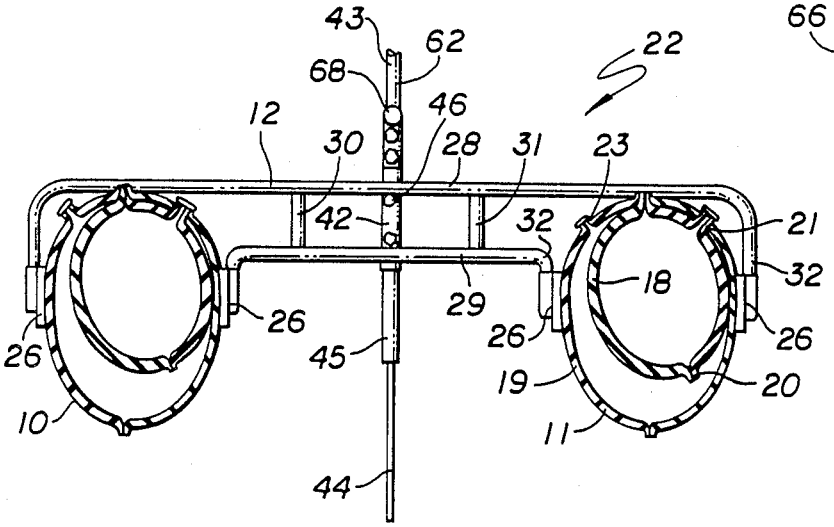
FIG. 6
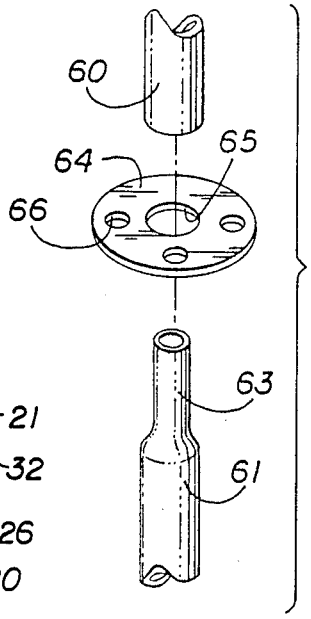
FIG. 7

INFLATABLE CATAMARAN

BACKGROUND OF THE INVENTION

This invention relates to a sailboat of the catamaran type, and in particular to a new and improved catamaran which is produced primarily of plastic sheet stock and plastic tubing so as to be inexpensive and easily assembled and disassembled so that the product can be shipped and sold in the disassembled state and assembled by the purchaser for use, and disassembled for storage.

Catamaran sailing vessels are well known and a variety of forms of construction have been utilized in the past. While these vessels have excellent sailing properties, they are awkward to transport and store and require some skill in assembly and handling. It is an object of the present invention to provide a new and improved inflatable catamaran which is easily assembled, handled and disassembled by youngsters and which is suitable for use by the youngsters in swimming pools, small lakes and the like. Another object is provide such a catamaran which is inexpensive to manufacture and sell so that it can be made available for use by children. However another object is to provide such a catamaran which can be used by an adult if desired.

These and other objects, advantages, features and results will more fully appear in the course of the following description.

SUMMARY OF THE INVENTION

A catamaran with first and second inflatable pontoons with each pontoon having forward and aft pockets on each side thereof, and first and second spreader members with each spreader member having four depending ends spaced laterally from one another, with the depending ends of the spreader members positionable in the pontoon pockets thereby joining the pontoons and spreader members in a rectangular catamaran form. A multiple section mast carried in a mast support tube on one of the spreader members, with a keel joined to the mast and mast support tube. A mast with telescoping mast sections and a stay ring supported at the junction of two of the sections, with stays for supporting the mast. A sail which is assembled with the mast sections and stay ring and additional spar and boom to provide a sail-mast assembly. Pontoons with inner and outer envelopes which are separately inflatable to provide safety in operation.

BRIEF DESCRIPTION OF THE DRAWINGS

FIG. 1 is a perspective view of a catamaran sailboat incorporating the presently preferred embodiment of the invention;

FIG. 2 in an enlarged partial sectional view taken along the line 2—2 of FIG. 1;

FIG. 3 is an enlarged partial sectional view taken along the line 3—3 of FIG. 1;

FIG. 4 is a side view illustrating the mast and sail assembly;

FIG. 5 is an enlarged view of a portion of FIG. 1 and illustrating one step in the assembly of the vessel;

FIG. 6 is an enlarged sectional view taken along the line 6—6 of FIG. 1; and

FIG. 7 is an exploded view illustrating a step in the assembly of the mast.

DESCRIPTION OF THE PREFERRED EMBODIMENT

The fully assembled catamaran is shown in FIG. 1 and includes pontoons 10, 11, spreader members 12, 13, a mast 14 and a sail 15. The pontoons 10, 11 preferably are identical in construction, and are shown in cross section in FIG. 6. Each pontoon includes an inner envelope 18 and an outer envelope 19. The inner envelope 18 typically is made from two identical sections which are cut from sheet plastic, with the two sections joined in a peripheral seam 20 by heat sealing or by an adhesive or the like. A conventional inflation plug 21 is fixed in one of the sections. The outer envelope 19 is produced in the same manner. A portion of the seam 20 of the inner envelope may be included in the seam of the outer envelope as indicated at 22. The outer envelope has a conventional inflation plug 23. The inflation plug 21 of the inner envelope projects through the outer envelope to the exterior, with the outer envelope sealed against the inner envelope at this location. With this arrangement, each pontoon has two floats of lesser capacity each, rather than one float of greater capacity. This makes inflation easier and provides safety in the event of failure of one of the envelopes.

Each of the pontoons has four pockets 26 mounted on the outer surface thereof. There are two forward pockets and two aft pockets, with two pockets on each side of the pontoon, with the forward pockets in lateral alignment and with the aft pockets in lateral alignment. The pocket 26 as shown in FIG. 5 is a plastic molding which is attached to the pontoon by an adhesive or by heat sealing as desired. Alternatively, the pocket can be formed of a piece of sheet stock which is joined to the pontoon.

The spreader members 12, 13 are substantially identical in construction, and the member 12 will be described in detail. U-shaped bars 28 and 29 are joined at their bights in spaced relation by spacer bars 30, 31. Preferably each of the bars is a length of plastic tubing, and the bars are joined together by cementing or by through bolts. The arms of the Us of the bars 28 and 29 provide four depending ends 32 which slide into the pockets 26, as seen in FIGS. 1 and 6. This provides the basic rectangular form of the catamaran with the two longitudinal pontoons and the two transverse spreader members.

Longitudinal side members 35, 36 are positioned between the fore and aft spreader members 12, 13 as shown in FIG. 1, thereby providing a deck area. A sheet 37 is supported between the side members 35, 36 and the spreader members 12, 13 by lacing 38. Typically, each of the side members 35, 36 has a threaded insert at each end, and is attached to the spreader member by a bolt 39.

A mast receiving tube 42 is affixed to the spreader member 12 for receiving the base of a mast 43. A plate 44 is attached to a shaft 45 to serve as a keel. The upper end of the shaft 45 is attached to the tube 42 by bolts 46 and nuts 47, with the bolts passing through openings in the lower end of the mast 43. This provides an easy assembly and disassembly of the keel and the mast with respect to the spreader member.

Another plate 50 is attached to another shaft 51 to serve as a rudder. Brackets 52, 53 are carried on the shaft 51 and have openings in alignment with openings in brackets 54, 55 carried on the transverse spreader member 13. A pin 56 is positioned in the openings in the brackets 52–55 to provide for pivoting action of the rudder. With this construction, the rudder is mounted by inserting the pin 56 and dismounted by removing the pin 56. Typically the plates for the keel and rudder are made of plastic sheet stock and the shafts and tubes are made of plastic tubing.

Typically the mast 43 is formed of three sections of aluminum tubing, comprising the upper section 60, the middle section 61 and the lower section 62. The upper end of the mast section 62 is telescoped into the lower end of the mast section 61, and the upper end of the mast section 61 is telescoped into the lower end of the mast section 60, the latter assembly being shown in FIG. 7 with the mast section 61 having an upper portion 63 of reduced diameter so as to slide into the mast section 60. A stay ring 64 has a central opening 65 for sliding over the upper end 63, and three additional openings 66 for terminating of stays 67. The lateral stays may be anchored to the longitudinal side members 35, 36, and the forward stay may be anchored to a forward projecting member 68 having a downward projecting end 69 attached to the mast receiving tube 42 by bolts 69*a* and nuts 69*b*.

The sail 15 has a vertical pocket 70 along the forward edge, with the pocket interrupted at an opening 71. The sail also has a horizontal pocket 72 on the bottom, a transverse pocket 73 which terminates adjacent the opening 71, and a pocket 74 along the trailing edge. Typically the sail is made of flexible plastic sheet stock and the pockets are produced by folding over an edge or adding a strip by stitching or heat or adhesive sealing. In assembly, the upper mast section 60 is inserted in the upper end of the pocket 70, the lower mast section 62 is inserted into the middle mast section 61 and this assembly is inserted in the lower portion of the pocket 70. The stay ring 64 is positioned at the opening 71, and the upper end 63 of the middle mast section 61 is passed through the opening 65 of the stay ring into the upper mast section 60, as shown in FIG. 7. A spar 77 is inserted into the pocket 73 and a boom 80 is inserted into the pocket 72. The line 75 has previously been inserted into the pocket 74, and may be anchored to the upper end of the mast. With this construction, the sail may be rotated on the mast and controlled by the line 75.

The catamaran is disassembled for storage by removing the stays and removing the mast from the spreader members by removing the bolts 46. The sail and mast are disassembled and the sail is folded. The deck sheet 37 is unlaced and the longitudinal side members 35, 36 are disconnected. The rudder is removed, the spreader members are lifted from the pockets in the pontoons, and the pontoons are deflated. The disassembly is now complete.

I claim:

1. In an inflatable catamaran, the combination of:

first and second inflatable pontoons, each of said pontoons having forward and aft pockets on each side of each pontoon, with each pocket providing an upwardly opening passage;

first and second spreader members, each of said spreader members having four depending ends spaced laterally from one another, with said depending ends positionable in said pontoon pockets in said passages and joining said pontoons and spreader members in a rectangular form, with each of said spreader members including first and second U-shaped bars joined in spaced relation at the bights thereof by spacer bars; and first and second longitudinal side members, with each of said side members positioned between said first and second spreader members with said spreader members and said side members cooperating to define a deck area.

2. In an inflatable catamaran, the combination of:

first and second inflatable pontoons, each of said pontoons having forward and aft pockets on each side of each pontoon, with each pocket providing an upwardly opening passage;

first and second spreader members, each of said spreader members having four depending ends spaced laterally from one another, with said depending ends positionable in said pontoon pockets in said passages and joining said pontoons and spreader members in a rectangular form;

a mast receiving tube carried on said first spreader member;

a keel having an upright shaft; a bowsprit member having an inboard end; and bolt means for joining said mast receiving tube, bowsprit member inboard end and keel shaft, with a mast positioned within said tube.

3. In an inflatable catamaran, the combination of:

first and second inflatable pontoons, each of said pontoons having forward and aft pockets on each side thereof, each of said pontoons including a first sealed envelope positioned within a second sealed envelope, with each of said envelopes having an inflation plug and with the inflation plug said first envelope projecting through said second envelope to the exterior of said pontoon;

first and second spreader members, each of said spreader members having four depending ends spaced laterally from one another, each of said spreader members including first and second U-shaped bars joined in spaced relation at the bights thereof by spacer bars, with said depending ends positionable in said pontoon pockets joining said pontoons and spreader members in a rectangular form;

first and second longitudinal side members, with each of said side members positioned between said first and second spreader members to define a deck area;

a mast receiving tube carried on said first spreader member;

a keel having an upright shaft;

bolt means for joining said mast receiving tube and keel shaft with a mast positioned within said tube;

a rudder having an upright shaft and first and second vertically spaced support brackets;

third and fourth vertically spaced support brackets carried on said second spreader member, with said four support brackets having aligned openings;

a pin positionable in said four support brackets or rotating support of said rudder on said second spreader member;

a mast comprising a plurality of interengaging tubular mast sections with one of said mast sections having an end of one diameter for telescopingly engaging an end of a different diameter of another member of said mast sections;

a stay ring having a central opening with said mast section end of lesser diameter positioned therein at the junction between said mast sections, said stay ring having a plurality of additional openings for receiving mast stays; and a sail having a vertical pocket for receiving said mast sections, with an opening in said vertical pocket for said stay ring, said sail having a transverse pocket terminating at said vertical pocket opening, for receiving a spar, and a horizontal pocket at the sail bottom for receiving a boom.

4. In an inflatable catamaran, the combination of:

first and second inflatable pontoons, each of said pontoons having forward and aft pockets on each side thereof;

first and second spreader members, each of said spreader members having four depending ends spaced laterally from one another, with said depending ends positionable in said pontoon pockets joining said pontoons and spreader members in a rectangular form;

a mast receiving tube carried on said first spreader member;

a keel having an upright shaft;

bolt means for joining said mast receiving tube and keel shaft with a mast positioned within said tube;

a rudder having an upright shaft and first and second vertically spaced support brackets;

third and fourth vertically spaced support brackets carried on said second spreader member, with said four support brackets having aligned openings; and a pin positionable in said four support brackets for rotating support of said rudder on said second spreader member

* * * * *